US005673606A

United States Patent [19]

Rose et al.

[11] Patent Number: 5,673,606

[45] Date of Patent: Oct. 7, 1997

[54] SWASH PLATE ACTUATING DEVICE FOR AXIAL PISTON PUMPS AND MOTORS

[75] Inventors: Charles E. Rose, Morris; Dale B. Childress, Plainfield, both of Ill.

[73] Assignee: Caterpillar Inc., Peoria, Ill.

[21] Appl. No.: 701,418

[22] Filed: Aug. 22, 1996

[51] Int. Cl.[6] ..... F01B 3/00

[52] U.S. Cl. ..... 92/12.2; 91/506

[58] Field of Search ..... 92/12.2; 91/505, 91/506; 417/222.1

[56] References Cited

U.S. PATENT DOCUMENTS

| | | | |
|---|---|---|---|
| 2,313,407 | 3/1943 | Vickers et al. | 92/12.2 |
| 5,406,878 | 4/1995 | Freeman et al. | 92/12.2 |

FOREIGN PATENT DOCUMENTS

| | | | |
|---|---|---|---|
| 1314483 | 12/1962 | France | 92/12.2 |
| 1228951 | 4/1971 | United Kingdom | 91/506 |

*Primary Examiner*—Thomas E. Denion
*Attorney, Agent, or Firm*—John W. Grant

[57] ABSTRACT

A swash plate actuating device for an axial piston unit has a swash plate tiltably mounted within the housing. A pair of axially aligned actuating chambers defined in the housing slidably receive the opposite ends of an elongate actuator and are disposed on opposite sides of a distal end portion formed on an actuator lever connected to the swash plate. A connector has a mounting portion spanning a transverse slot in the actuator and seated on a planar surface of the actuator. A guide portion of the connector is disposed within the transverse slot and has a bearing slot slidably receiving the distal end portion of the actuator lever.

2 Claims, 2 Drawing Sheets

SWASH PLATE ACTUATING DEVICE FOR AXIAL PISTON PUMPS AND MOTORS

TECHNICAL FIELD

This invention relates generally to variable displacement axial piston pumps and motors and more particularly to a swash plate actuating device for tilting the swash plate relative to a housing for controlling the displacement of the pumps and motors.

BACKGROUND ART

Variable displacement axial piston pumps and motors in which a swash plate is tilted relative to a housing for controlling the displacement of pistons within piston bores of a rotating barrel are well known. Many of such pumps and motors include a lever secured to the swash plate and has a distal end positioned adjacent an actuator mounted on or within the pump housing. To make the pumps or motors more compact while providing easy assembly of the rotating group, the hydraulic actuator of one pump design has a transverse slot machined in one side adjacent the rotating barrel. The distal end of the lever is suitably seated in a slide block slidably disposed in the transverse slot. An example of the above design is disclosed in U.S. Pat. No. 5,406,878.

One of the problems encountered with such arrangements is that the transverse slot weakens the actuator somewhat such that deflections can occur across the connector assembly connecting the lever arm to the actuator due to high axial loads generated in the actuator by actuating forces acting on opposite ends of the actuator. Deflections in the actuator increases friction between the sliding components causing undue wear to the slide block which is often made of softer bearing material. Such wear creates slight variations in the tilted position of the swash plate relative to the movement of the actuator.

Thus, it would be desirable to provide a swash plate actuating device for an axial piston unit which retains the easy assembly feature of the above mentioned design while stiffening the lever-to-actuator connection sufficiently to prevent undue wear to the mating parts.

The present invention is directed to overcoming one or more of the problems as set forth above.

DISCLOSURE OF THE INVENTION

In one aspect of the present invention, a swash plate actuating device for an axial piston unit has a housing and a swash plate tiltably mounted within the housing. The swash plate has an actuator lever extending therefrom with the distal end portion of the lever having a cylindrical shaped surface. A pair of axially aligned actuating chambers defined in the housing are disposed on opposite sides of the distal end portion. An elongate actuator has opposite end portions slidably positioned within the actuating chambers for rectilinear movement therein and has a planar surface perpendicular to a transverse slot. A connector has a guide portion seated within the transverse slot, a bearing slot slidably receiving the distal end portion, and a mounting portion spanning the transverse slot and seated on the planar surface.

BEST MODE FOR CARRYING OUT THE INVENTION

Figure 1:
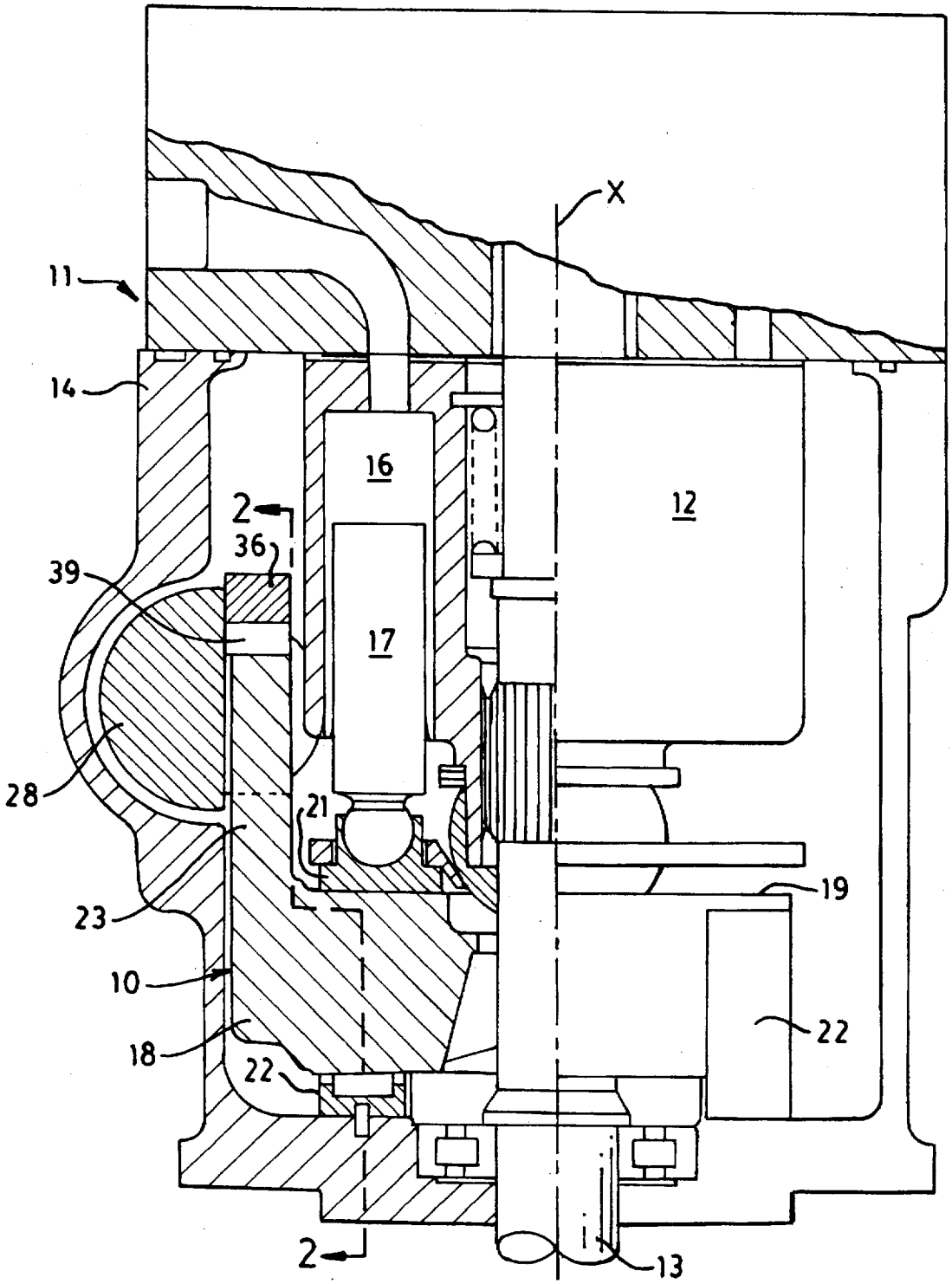
FIG. 1 is a cross-sectional view of an embodiment of the present invention.

A swash plate actuating device 10 is used in a variable displacement axial piston hydraulic unit 11. The hydraulic unit 11 may be either a pump or a motor and has a rotatable barrel 12 secured to a shaft 13 and which rotates about a central axis X. The barrel 12 is disposed within a housing 14 and has a plurality of equally spaced circumferentially arranged piston bores, one shown at 16. A plurality of pistons, one shown at 17, are individually reciprocatably positioned within the piston bores. A swash plate 18 is positioned within the housing at one end thereof and has a planer surface 19. The ends of the pistons are suitably individually seated in a plurality of piston slippers 21 slidably engaging the planer surface of the swash plate to control or vary the displacement of the pistons within the piston bores. The swash plate 18 is tiltably mounted within the housing 14 by a pair of laterally spaced roller bearing assemblies 22. An actuating lever 23 is secured to and extends from the swash plate and has a cylindrical shaped force transmitting surface 24 formed on a distal end portion 25 of the lever.

The swash plate actuating device 10 includes a pair of axially aligned actuating chambers 26,27 defined in the housing 14 and disposed on opposite sides of the distal end portion 25. An elongate actuator 28 having opposite end portions 29,31 is slidably positioned within the actuating chambers 26,27, respectively for rectilinear movement therein. The actuator 28 has a flat surface 32 formed therein facing the inside of the housing, a transverse slot 33 formed in the flat surface facing the barrel 12, and a planar surface 34 perpendicular to the transverse slot.

A unitary connector 36 has a mounting portion 37 spanning the transverse slot 33 and seated on the planar surface 34, a bifurcated guide portion 38 extending from the mounting portion 37 and into the transverse slot. A bearing slot 39 is formed in the bifurcated guide portion and slidably receives the distal end portion of the lever. The connector 36 is suitably fastened to the actuator 28 by a pair of bolts 41. The connector in this embodiment is made from hardened steel.

Industrial Applicability

Figure 2:
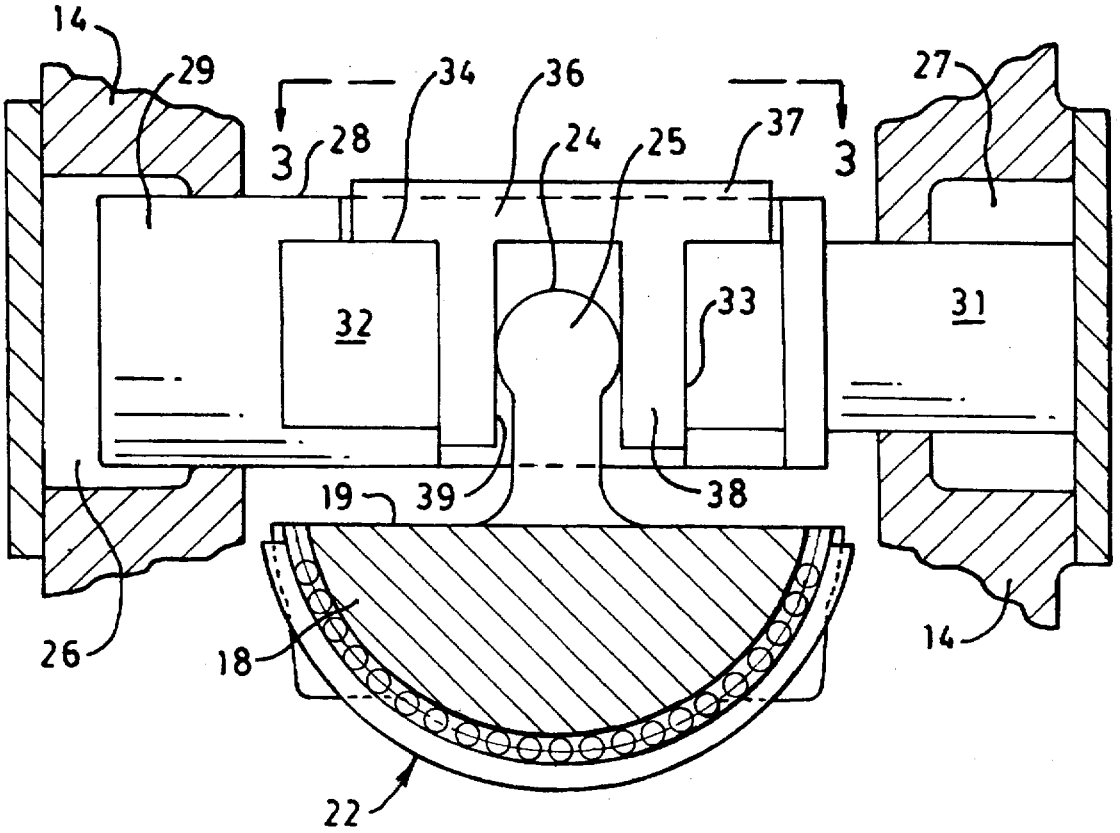
FIG. 2 is a sectional view taken generally along line 2—2 of FIG. 1.
Figure 3:
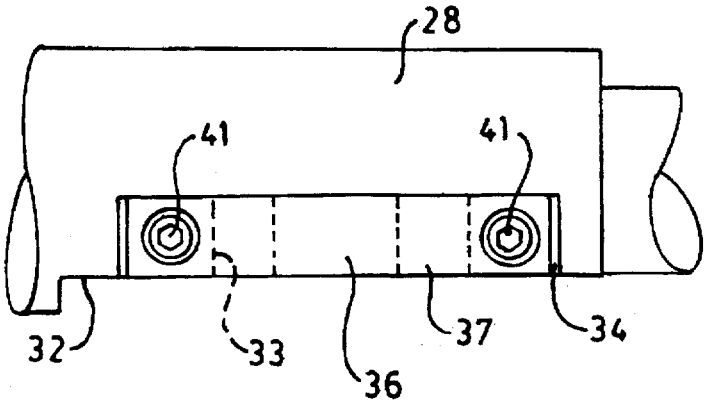
FIG. 3 is a elevational view taken generally along line 3—3 of FIG. 1.

In use of the axial piston unit 11, the swash plate 18 is tilted or pivoted on the roller bearing assemblies 22 to an infinite number of operating positions between a first or neutral position of minimum fluid displacement in which the planer surface 19 is perpendicular to the axis of the barrel and a second position of maximum fluid displacement in which the planer surface is at a maximum displacement angle with respect to the axis of the barrel. Tilting of the swash plate from the neutral position shown is achieved by introducing pressurized fluid into the actuating chamber 27 in the usual manner. This causes rectilinear movement of the actuator 28 leftward as viewed in FIG. 2. This leftward movement causes the distal end portion 39 of the lever 37 to slide in the bearing slot pivoting the swash plate in a counterclockwise direction about the axis of the bearing assemblies 22. The swash plate is returned to the minimum displacement position by suitably introducing pressurized fluid into the actuating chamber 27.

Positioning the guide portion 38 in the transverse slot 33 and bridging the transverse slot with the connector 36 strengthen the lever-to-actuator connection to prevent the actuator from deflecting under axial loading.

Other aspects, objects and advantages of this invention can be obtained from a study of the drawings, disclosure and the appended claims.

We claim:

1. A swash plate actuating device for an axial piston unit having a housing and a swash plate tiltably mounted within the housing, the swash plate having an actuator lever extending therefrom with the distal end portion of the lever having a force transmitting surface, comprising:

a pair of axially aligned actuating chambers defined in the housing and disposed on opposite sides of the distal end portion;

an elongate actuator having opposite end portions slidably positioned within the actuating chambers for rectilinear movement therein, the actuator having a transverse slot therein and a planar surface perpendicular to the transverse slot;

a unitary connector having a bifurcated guide portion seated within the transverse slot, a bearing slot formed in the bifurcated guide portion and slidably receiving the distal end portion, and a mounting portion spanning the transverse slot and seated on the planar surface.

2. The swash plate actuating device of claim 1 wherein the connector is removably fastened to the actuator.

* * * * *